US010262640B2

(12) United States Patent
Takehisa et al.

(10) Patent No.: US 10,262,640 B2
(45) Date of Patent: Apr. 16, 2019

(54) MUSICAL PERFORMANCE SUPPORT DEVICE AND PROGRAM

(71) Applicant: YAMAHA CORPORATION, Hamamatsu-shi (JP)

(72) Inventors: Hideaki Takehisa, Hamamatsu (JP); Mikihiro Hiramatsu, Hamamatsu (JP); Takuma Yamazaki, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/952,837

(22) Filed: Apr. 13, 2018

(65) Prior Publication Data

US 2018/0308460 A1 Oct. 25, 2018

(30) Foreign Application Priority Data

Apr. 21, 2017 (JP) ..... 2017-084623

(51) Int. Cl.

| | |
|---|---|
| ***A63H 5/00*** | (2006.01) |
| ***G04B 13/00*** | (2006.01) |
| ***G10H 1/00*** | (2006.01) |
| ***G10H 1/42*** | (2006.01) |

(52) U.S. Cl.

CPC ..... *G10H 1/0008* (2013.01); *G10H 1/42* (2013.01); *G10H 2210/076* (2013.01); *G10H 2220/005* (2013.01); *G10H 2230/015* (2013.01)

(58) Field of Classification Search

CPC ..... G10H 2210/076; G10H 1/42; G10H 2220/005; G10H 2230/015

USPC ..... 84/609

See application file for complete search history.

(56) References Cited

U.S. PATENT DOCUMENTS

| | | | | |
|---|---|---|---|---|
| 5,430,243 | A * | 7/1995 | Shioda | G10H 1/0066 84/645 |
| 7,177,672 | B2 * | 2/2007 | Nissila | A61B 5/024 600/500 |
| 8,076,566 | B2 * | 12/2011 | Yamashita | G10H 1/40 84/611 |
| 2006/0032362 | A1 * | 2/2006 | Reynolds | G09B 15/00 84/601 |
| 2006/0169125 | A1 * | 8/2006 | Ashkenazi | A63B 71/0686 84/612 |

(Continued)

FOREIGN PATENT DOCUMENTS

JP 2003150162 A 5/2003

OTHER PUBLICATIONS

IK Multimedia. "iRig Recorder 3." Web URL: http://www.ikmultimedia.com/products/irigrecorder/ Apr. 21, 2017.

(Continued)

*Primary Examiner* — Jeffrey Donels

(74) *Attorney, Agent, or Firm* — Rossi, Kimms & McDowell LLP

(57) ABSTRACT

A musical performance support device includes: a tempo analysis unit that analyzes a tempo of musical piece sound data, the musical piece sound data indicating a musical piece sound; a sound generation unit that generates a sound based on the analyzed tempo, the generated sound indicating a beat of the musical piece sound data; and a sound processing unit that adds the generated sound to the musical piece sound.

15 Claims, 6 Drawing Sheets

(56) References Cited

U.S. PATENT DOCUMENTS

| | | | | |
|---|---|---|---|---|
| 2008/0115656 | A1* | 5/2008 | Sumita | G10G 3/04 84/612 |
| 2010/0188405 | A1* | 7/2010 | Haughay, Jr. | A63B 24/0062 345/440 |
| 2010/0222906 | A1* | 9/2010 | Moulios | G10H 1/40 700/94 |
| 2017/0047082 | A1* | 2/2017 | Lee | G10H 1/0008 |

OTHER PUBLICATIONS

Yamaha. "Chord Tracker." Web URL http://usa.yamaha.com/products/apps/chord_tracker/ Apr. 21, 2017.

* cited by examiner

MUSICAL PERFORMANCE SUPPORT DEVICE AND PROGRAM

CROSS-REFERENCE TO RELATED APPLICATION

Priority is claimed on Japanese Patent Application No. 2017-084623, filed Apr. 21, 2017, the content of which is incorporated herein by reference.

BACKGROUND OF THE INVENTION

Field of the Invention

The present invention relates to a musical performance support device and a program.

Description of Related Art

In recent years, making an audio and a video recording of a musical performance of a musical instrument such as an electronic drum to generate content for the musical performance, and posting (uploading) the content of the musical performance to a server device for a moving image sharing service or the like have been performed. Further, a technology for supporting such audio recording, video recording, content generation, and posting (uploading) for a musical performance is known (see, for example, IK Multimedia iRig Recorder", [online], [accessed on Apr. 9, 2017], Internet <URL:http://www.ikmultimedia.com/products/irigrecorder/>).

SUMMARY OF THE INVENTION

However, in the related art described above, the audio recording, the video recording, the content generation, and the posting are generally performed on the musical performance improved to a certain extent, but the related art does not perform support for practicing for improving the musical performance and it may be inconvenient to perform practicing for a musical performance.

The present invention has been made to solve the above problems. An exemplary object of the present invention is to provide a musical performance support device and a program that can improve convenience.

A musical performance support device according to an aspect of the present invention includes: a tempo analysis unit that analyzes a tempo of musical piece sound data, the musical piece sound data indicating a musical piece sound; a sound generation unit that generates a sound based on the analyzed tempo, the generated sound indicating a beat of the musical piece sound data; and a sound processing unit that adds the generated sound to the musical piece sound.

A non-transitory computer-readable recording medium according to an aspect of the present invention stores a program. The program causes a computer to execute: analyzing a tempo of musical piece sound data, the musical piece sound data indicating a musical piece sound; generating a sound based on the analyzed tempo, the generated sound indicating a beat of the musical piece sound data; and adding the generated sound to the musical piece sound.

A musical performance support method according to an aspect of the present invention includes: analyzing a tempo of musical piece sound data, the musical piece sound data indicating a musical piece sound; generating a sound based on the analyzed tempo, the generated sound indicating a beat of the musical piece sound data; and adding the generated sound to the musical piece sound.

According to the present invention, it is possible to improve convenience.

DETAILED DESCRIPTION OF THE INVENTION

Hereinafter, a musical performance support device and a program according to an embodiment of the present invention will be described with reference to the drawings.

Figure 1:
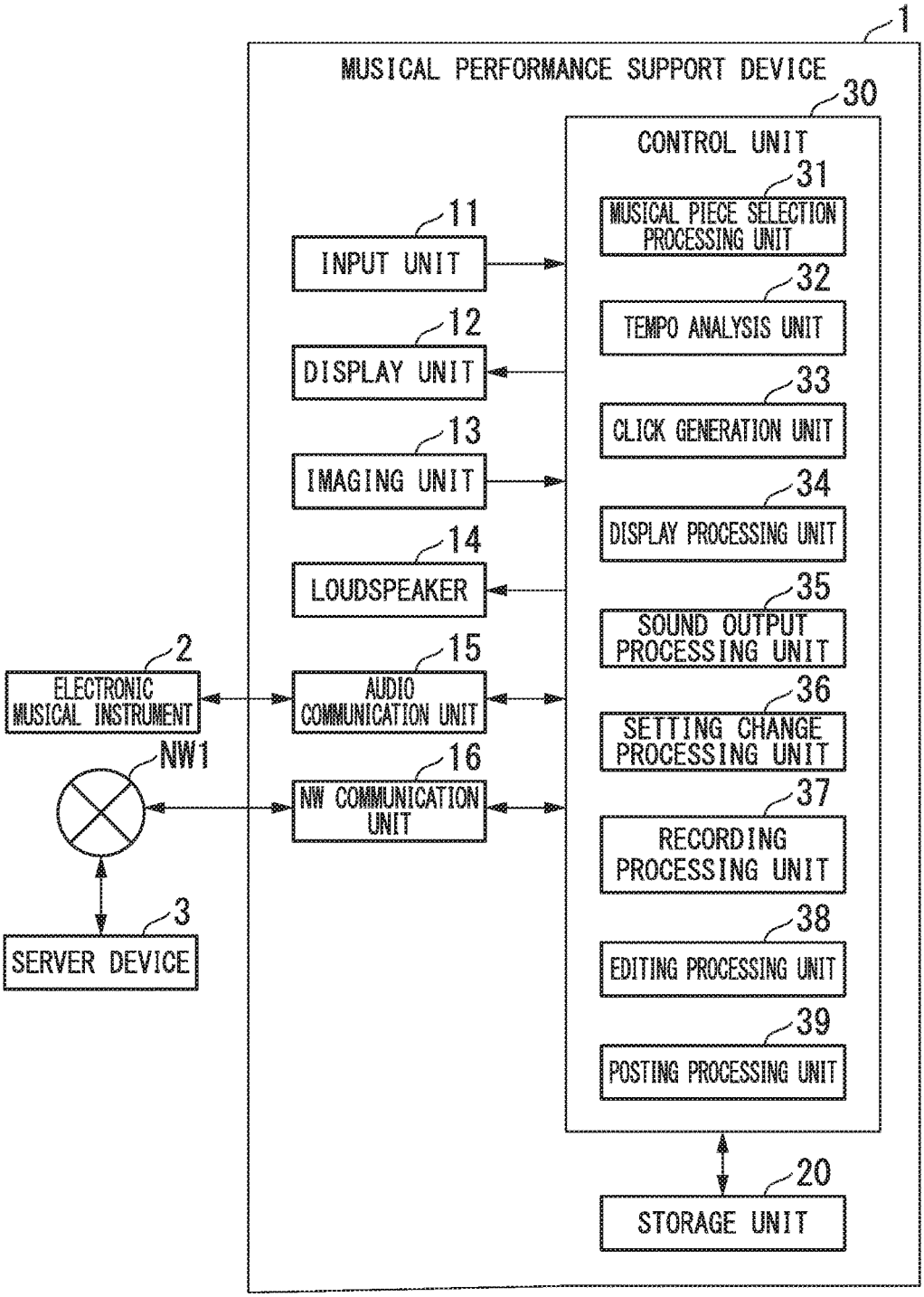
FIG. 1 is a functional block diagram showing an example of a musical performance support device according to an embodiment.

FIG. 1 is a functional block diagram showing an example of a musical performance support device 1 according to the embodiment.

As shown in FIG. 1, the musical performance support device 1 includes an input unit 11, a display unit 12, an imaging unit 13, a loudspeaker 14, an audio communication unit 15, a network (NW) communication unit 16, a storage unit 20, and a control unit 30.

The musical performance support device 1 is, for example, an information processing device such as a smartphone or a personal computer (PC), and can be connected to an electronic musical instrument 2 and can be connected to a network NW1. Further, the musical performance support device 1 may be realized by executing an application program or may be realized by dedicated hardware.

The musical performance support device 1 executes total assistance of a musical instrument performance process from practicing (training) for a musical performance of a musical piece using the electronic musical instrument 2 to recording of the musical performance (recording of a musical performance sound and musical performance images), creating and editing of content data of the musical performance, and posting of the content data.

The electronic musical instrument 2 is, for example, an instrument such as an electronic drum, and is connected to the musical performance support device 1.

The electronic musical instrument 2 converts performance sound obtained from a musical performance of a user into musical performance data and transmits the musical performance data to the musical performance support device 1.

The input unit 11 is, for example, an input device such as a touch panel or a keyboard and receives an input of various types of information to the musical performance support device 1.

The display unit 12 is, for example, a liquid crystal display, and displays a menu screen, an operation screen, a settings screen, and the like when various processes of the musical performance support device 1 are executed.

The imaging unit 13 is, for example, a CCD camera, and captures various images. The imaging unit 13 captures musical performance images of the user in a recording process to be described below.

The loudspeaker 14 (an example of a sound emission unit) emits (outputs) various sounds. The loudspeaker 14 outputs, for example, a musical piece sound, a click sound (beat sound) to be described below, a musical performance sound recorded through a recording process, and the like.

The audio communication unit 15 is, for example, an interface unit conforming to a universal serial bus (USB) Audio Class standard and performs communication with the electronic musical instrument 2. The musical performance support device 1 acquires the musical performance data from the electronic musical instrument 2 via the audio communication unit 15.

The NW communication unit 16 is connected to the network NW1 using, for example, wired local area network (LAN) communication, wireless LAN communication, or mobile communication, and performs communication with a server device 3 over the network NW1.

Here, the musical performance support device 1 can be connected to the server device 3 over the network NW1, and the server device 3 is, for example, a server device that provides a moving image sharing service such as YouTube.

The storage unit 20 stores information that is used for various processes of the musical performance support device 1. The storage unit 20 stores, for example, musical piece sound data to be reproduced, recorded musical performance data, and image data. Further, the storage unit 20 stores various pieces of settings information for practicing (training) for a musical performance of the electronic musical instrument 2.

The control unit 30 is a processor including, for example, a central processing unit (CPU), and controls the entire musical performance support device 1. The control unit 30 executes various types of support of processes from practicing (training) for a musical performance of a musical piece using the electronic musical instrument 2 to recording of the musical performance (recording of a musical performance sound and a musical performance image), creation and editing of content data of the musical performance, and posting of the content data.

The control unit 30 includes a musical piece selection processing unit 31, a tempo analysis unit 32, a click generation unit 33, a display processing unit 34, a sound output processing unit 35, a setting change processing unit 36, a recording processing unit 37, an editing processing unit 38, and a posting processing unit 39.

The musical piece selection processing unit 31 executes practicing for a musical performance of the electronic musical instrument 2 or a process of selecting musical piece sound data to be used for recording. Here, the musical piece sound data is data indicating a musical piece sound and is used for reproduction (emission) of a musical piece sound. The musical piece selection processing unit 31 selects the musical piece sound data from among a plurality of pieces of musical piece sound data stored in the storage unit 20, for example, on the basis of information received by the user via the input unit 11.

The tempo analysis unit 32 analyzes a tempo (a length of one beat) of the musical piece sound data selected by the musical piece selection processing unit 31. The tempo analysis unit 32, for example, analyzes the selected tempo of the musical piece sound data using a technology that is used in "Chord Tracker" (Internet <URL:http://usa.yamaha.com/products/apps/chord_tracker/>). The tempo analysis unit 32 stores the analysis result of the tempo, for example, in the storage unit 20. It should be noted that the analysis result of the tempo analyzed by the tempo analysis unit 32 includes, for example, speed information of the musical piece or rhythm information.

Further, in the embodiment, it is possible to set an analysis range of the musical piece sound data and a scaling factor (for example, ½ times or two times) of the analysis in order to improve the accuracy of the analysis of the tempo. The tempo analysis unit 32, for example, analyzes the tempo of the musical piece sound data in the analysis range designated by the input unit 11 among the musical piece sound data. Further, the tempo analysis unit 32 analyzes the tempo of the musical piece sound data, for example, according to the designated scaling factor.

The click generation unit 33 (an example of sound generation unit) generates a click sound (a metronome sound) to beat out of a predetermined rhythm on the basis of the tempo analyzed by the tempo analysis unit 32. That is, the click generation unit 33 generates a click sound for the musical piece sound selected by the musical piece selection processing unit 31 on the basis of the tempo analysis result of the tempo analysis unit 32. Here, the click sound to beat out of a predetermined rhythm is, for example, a click sound with a predetermined rhythm or a click sound matching a predetermined rhythm. It should be noted that for the click sound, any one of an on beat and an off beat can be selected (set) according to beat settings information to be described below, and the click generation unit 33 generates the click sound corresponding to any one of the on beat and the off beat on the basis of the beat settings information.

The display processing unit 34 displays a menu screen, an operation screen, a settings screen, and the like when various processes are executed, on the display unit 12. The display processing unit 34, for example, displays tempo information (a BPM value: Beats Per Minute value) indicating the tempo of the musical piece sound, waveform data of the musical piece sound, settings information of the click sound, and the like when the menu screen and the operation screen for practicing (training) for a musical performance are displayed on the display unit 12.

The sound output processing unit 35 (an example of a sound emission processing unit and/or a sound processing unit) adds the click sound generated by the click generation unit 33 to the musical piece sound according to the musical piece sound data, and causes a resultant sound to be emitted from the loudspeaker 14. Further, the sound output processing unit 35, for example, causes the musical piece sound and the click sound of which the tempo has been changed, a musical piece sound obtained by repeatedly reproducing a predetermined range of the musical piece sound data, and the like to be emitted from the loudspeaker 14 at the time of practicing (training) for a musical performance. Further, the sound output processing unit 35 causes the musical piece sound according to the musical piece sound data to be emitted from the loudspeaker 14 (a sound emission unit) according to various pieces of set settings information. Further, the sound output processing unit 35, for example, mixes the musical piece sound data with the musical performance data acquired from the electronic musical instrument 2 at the time of recording and editing processes and causes sound to be emitted from the loudspeaker 14.

The setting change processing unit 36 changes a setting of settings information for analyzing the tempo, settings information for practicing (training) for a musical performance of the electronic musical instrument 2, and settings information for recording and editing processes on the basis of information received from the input unit 11. That is, the setting change processing unit 36 changes various pieces of settings information stored in the storage unit 20 on the basis of the information received (information designated) from the input unit 11.

The setting change processing unit 36 changes, for example, the tempo of the musical piece sound to be emitted by the sound output processing unit 35 according to a tempo change request received by the input unit 11, and changes a generation time interval of the click sound generated by the click generation unit 33, according to the change in the tempo of the musical piece sound. Further, the setting change processing unit 36, for example, changes the beat settings information for selecting any one of an on beat and an off beat according to a click sound change request received by the input unit 11.

The recording processing unit 37 (an example of an audio recording processing unit) acquires musical performance sound data indicating the musical performance sound played using the electronic musical instrument 2 according to the musical piece sound emitted by the loudspeaker 14 and stores the acquired musical performance sound data in the storage unit 20. Further, the recording processing unit 37, for example, stores the image data (musical performance image data) acquired from the imaging unit 13, which captures an image in which the electronic musical instrument 2 performs a musical performance, in the storage unit 20 together with the musical performance sound data.

The editing processing unit 38 (an example of a content generation unit) edits the musical performance sound data recorded by the recording processing unit 37 and the musical piece sound data obtained by reproducing the musical piece to generate content data for posting. That is, the editing processing unit 38 generates content data on the basis of the musical performance sound data stored in the storage unit 20 by the recording processing unit 37 and the musical piece sound data, and stores the generated content data in the storage unit 20.

It should be noted that the image data may be included in the content data, and the editing processing unit 38 may acquire the image data (musical performance image data) acquired from the imaging unit 13 or separately acquire the image stored in the storage unit 20 to generate content data including the image data.

Further, the editing processing unit 38 has a function of changing a volume balance between the musical performance sound data and the musical piece sound data and mixing the musical performance sound data with the musical piece sound data, and a function of changing a range (an editing range) of the musical performance sound data and the musical piece sound data for generating the content data. That is, the editing processing unit 38, for example, generates the content data according to the editing range received by the input unit 11 and information on the volume balance between the musical performance sound data and the musical piece sound data.

The posting processing unit 39 executes the process of posting the content data to the server device 3 that provides a moving image sharing service or the like. The posting processing unit 39 receives the moving image sharing service of a posting destination using the input unit 11, and transmits, for example, the content data generated by the editing processing unit 38 to the server device 3 corresponding to the moving image sharing service so that the content data is stored (registered). It should be noted that the posting processing unit 39 transmits the content data to the server device 3 via the NW communication unit 16.

Next, an operation of the musical performance support device 1 according to the embodiment will be described with reference to the drawings.

Figure 2:
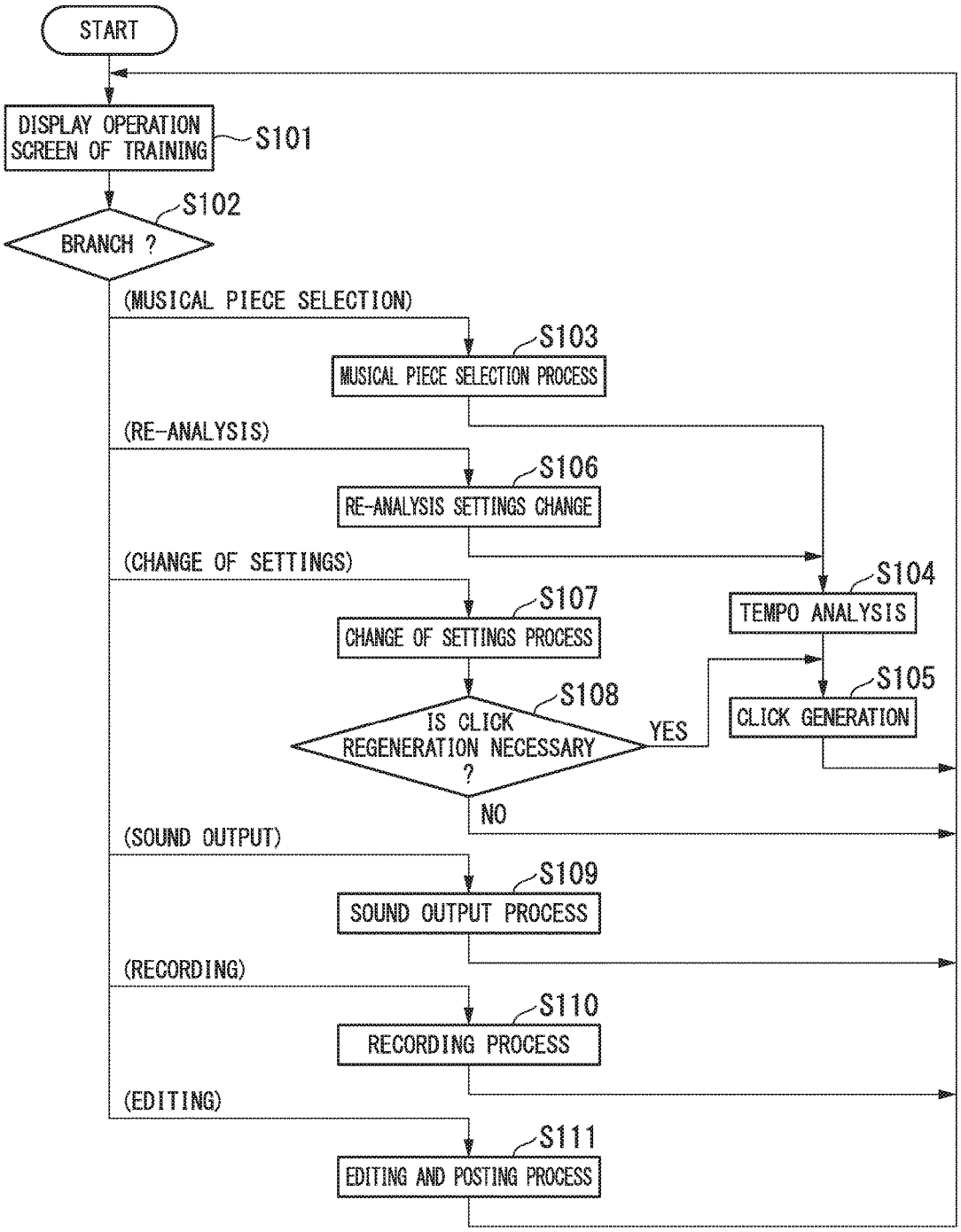
FIG. 2 is a flowchart showing an example of an operation of the musical performance support device according to the embodiment.

FIG. 2 is a flowchart showing an example of an operation of the musical performance support device 1 according to the embodiment.

Figure 3:
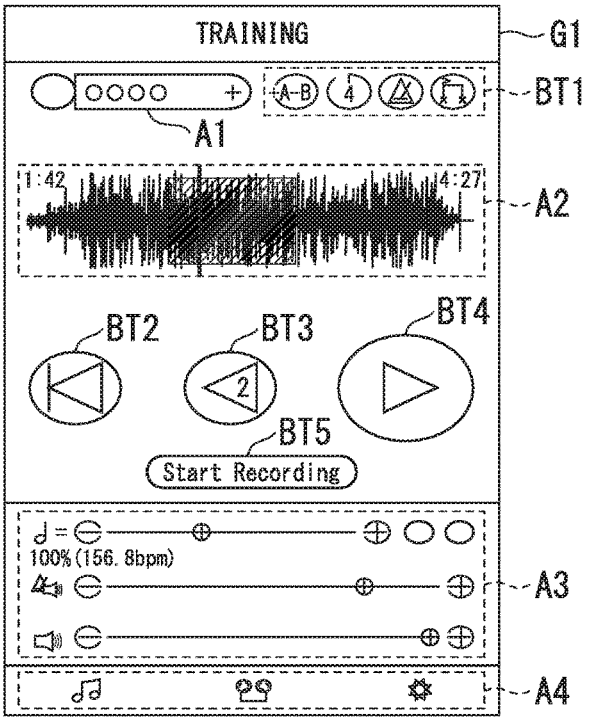
FIG. 3 is a diagram showing an example of a training operation screen of the musical performance support device according to the embodiment.

As shown in FIG. 2, the musical performance support device 1 first displays an operation screen of training (step S101). The display processing unit 34 of the musical performance support device 1 causes, for example, the display unit 12 to display a display screen G1 as shown in FIG. 3 as a training operation screen. Here, the training operation screen (the display screen G1) shown in FIG. 3 will be described.

FIG. 3 is a diagram showing an example of the training operation screen of the musical performance support device 1 according to the embodiment. In FIG. 3, an area A1 indicates an area for selecting a musical piece, and a musical piece name and an artist name corresponding to the musical piece sound data selected by the musical piece selection processing unit 31 are displayed.

Further, a button BT1 indicates an "AB repeat" button, a "pre-count" button, a "click switch" button, and a "beat shift" button which are for training settings information.

The "AB repeat" button is used to set a function of repeating a range from a point A to a point B in the musical piece sound and set ON and OFF of the function. Further, the "pre-count" button is used to set ON and OFF of a function of inserting a pre-count using click sound before the musical piece sound is emitted.

Also, the "click switch" button sets ON and OFF of the click sound. The "beat shift" button is a setting button for switching between an on beat and an off beat of the click sound.

Further, an area A2 is an area in which waveform data of the musical piece sound is displayed. A locator can be operated by tapping and sliding the area.

Further, the button BT2 indicates a "Go to Beginning" button for moving the musical piece sound to a beginning, and a button BT3 indicates, for example, a "rewind" button for rewinding for two seconds. Further, a button BT4 indicates a "play" button for performing playback and stop of the musical piece sound.

Further, a button BT5 indicates a "Start Recording" button for switching to a recording screen for recording (audio recording).

Further, an area A3 is an area for adjusting the tempo of the musical piece sound, and indicates an area in which change of tempo scaling factor, switching to a tempo re-analysis process, click sound volume adjustment, musical piece sound volume adjustment, and the like are performed on the basis of the tempo analyzed by the tempo analysis unit 32. It should be noted that tempo information (a BPM value) indicating the tempo of the musical piece sound is displayed in the area A3.

Further, an area A4 is an operation area for switching to an editing and posting screen and a setting changing screen.

Returning to the description of FIG. 2, the control unit 30 of the musical performance support device 1 branches to various processes according to the input operation received by the input unit 11 (step S102). When the control unit 30 receives, for example, a musical piece selection operation via the input unit 11 through the area A1, the control unit 30 proceeds to a process of step S103. Further, when the control unit 30 receives, for example, a tempo re-analysis process via the input unit 11 through an operation of the area A3, the control unit 30 proceeds to a process of step S106.

Further, when the control unit 30 receives, for example, various change of settings through an operation of the button BT1, the area A3, and the area A4 via the input unit 11, the control unit 30 proceeds to a process of step S107. Further, when the control unit 30 receives, for example, a sound output process through an operation of the buttons BT2 to BT4 via the input unit 11, the control unit 30 proceeds to a process of step S109. Further, for example, when the control unit 30 receives the recording (audio recording) through an operation of the button BT5 via the input unit 11, the control unit 30 proceeds to a process of step S110. Further, when the control unit 30 receives, for example, an editing process through an operation of the area A4 via the input unit 11, the control unit 30 proceeds to a process of step S111.

In step S103, the musical piece selection processing unit 31 of the control unit 30 executes a musical piece selection process. The musical piece selection processing unit 31, for example, selects the musical piece sound data selected by the user via the input unit 11 from among a plurality of pieces of musical piece sound data stored in the storage unit 20.

Next, the tempo analysis unit 32 analyzes the tempo of the musical piece sound data selected by the musical piece selection processing unit 31 (step S104). The click generation unit 33 generates a click sound (metronome sound) on the basis of the tempo analyzed by the tempo analysis unit 32 (step S105). After the process of step S105, the click generation unit 33 causes the process to return to step S101.

Figure 4:
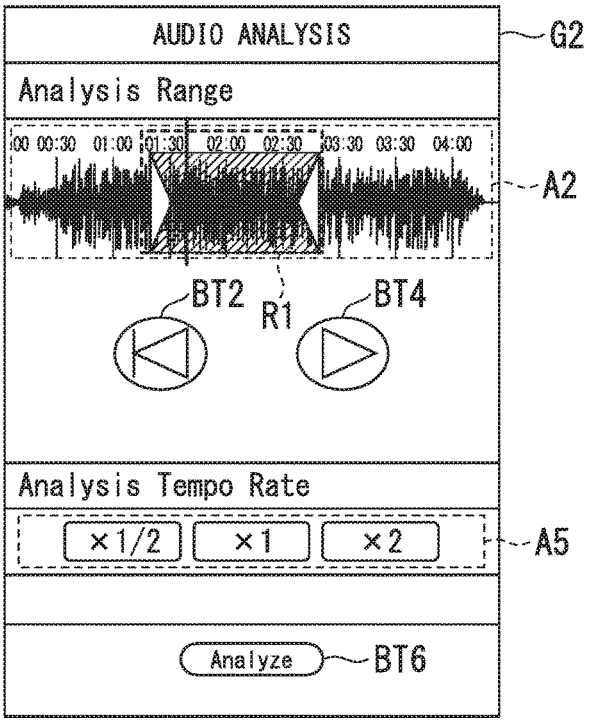
FIG. 4 is a diagram showing an example of a tempo analysis processing screen of the musical performance support device according to the embodiment.

Further, in step S106, the setting change processing unit 36 executes a process of changing re-analysis settings. The setting change processing unit 36 causes the display processing unit 34 to display, for example, an audio analysis screen (a display screen G2) as illustrated in FIG. 4 on the display unit 12. Here, the audio analysis screen (the display screen G2) illustrated in FIG. 4 will be described.

FIG. 4 is a diagram showing an example of an audio analysis screen of the musical performance support device 1 according to the embodiment. In FIG. 4, the area A2 is an area in which the waveform data of the musical piece sound is displayed, similar to FIG. 3 described above, and the analysis range R1 can be set via the input unit 11. Further, an area A5 is an area in which a scaling factor of the analysis (for example, ½ times or 2 times) is set. Further, a button BT6 indicates an analysis button (an "Analyze" button) for executing analysis.

In step S106, the setting change processing unit 36, for example, changes the setting of the analysis range R1 according to the operation of the area A2 and changes the setting of the scaling factor of the analysis according to the operation of the area A5. Further, the setting change processing unit 36 causes the tempo analysis unit 32 to execute the re-analysis of the tempo according to the operation of the button BT6. That is, the setting change processing unit 36 proceeds to the process of step S104, and the tempo analysis unit 32 re-analyzes the tempo for the musical piece sound data in the changed analysis range according to the changed setting of the scaling factor of the analysis.

Further, in step S107, the setting change processing unit 36 executes various change of settings processes. For example, when the setting change processing unit 36 receives the change of settings through the button BT1 and the area A3, the setting change processing unit 36 executes corresponding change of settings and stores settings information in the storage unit 20. It should be noted that a case in which the change of settings is performed by operating the area A4 will be described below with reference to FIG. 10.

Next, the setting change processing unit 36 determines whether regeneration of the click sound is necessary due to the change of settings (step S108). For example, the setting change processing unit 36 determines, for example, whether or not regeneration of the click sound is necessary, due to the "beat shift" button, the tempo scaling factor change (a tempo change request), or the like. When the regeneration of the click sound is necessary (step S108: YES), the setting change processing unit 36 proceeds to the process of step S105 to cause the click generation unit 33 to regenerate the click sound. Also, when the regeneration of the click sound is not necessary (step S108: NO), the setting change processing unit 36 causes the process to return to step S101.

In step S109, the sound output processing unit 35 executes the sound output process according to an operation. For example, the sound output processing unit 35 adds the click sound generated by the click generation unit 33 to the musical piece sound according to the musical piece sound data according to the operation of clicking the button BT4, and causes a resultant sound to be emitted from the loudspeaker 14. Further, the sound output processing unit 35, for example, causes the musical piece sound and the click sound of which the tempo has been changed, the musical piece sound obtained by repeatedly reproducing a predetermined range of the musical piece sound data, or the like to be emitted from the loudspeaker 14 according to the operation of the button BT3 or the area A3. After the process of step S109, the sound output processing unit 35 causes the process to return to step S101.

Figure 5:
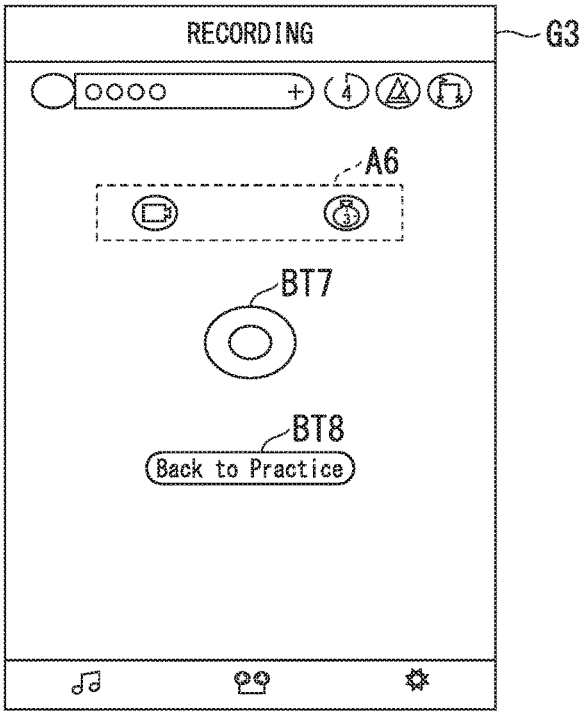
FIG. 5 is a first diagram showing an example of a recording processing screen of the musical performance support device according to the embodiment.

Further, in step S110, the recording processing unit 37 executes the recording process. The recording processing unit 37 causes the display processing unit 34 to display, for example, the recording processing screen (the display screen G3) as shown in FIG. 5 on the display unit 12. The recording processing screen (the display screen G3) shown in FIG. 5 will be described herein.

FIG. 5 is a first diagram showing an example of the recording processing screen of the musical performance support device 1 according to the embodiment. In FIG. 5, an area A6 is an area in which ON and OFF as to whether or not the imaging unit 13 is to be used in the recording process is set, and a time of a self-timer and ON and OFF thereof are set. Further, a button BT7 is a recording start button, and a button BT8 is an operation button for returning to the training operation screen (the display screen G1). It should be noted that the example shown in FIG. 5 is a display example when the imaging unit 13 is not used (when the imaging unit 13 is turned OFF), and when the imaging unit 13 is used (when the imaging unit 13 is turned ON), the captured image of the imaging unit 13 is displayed on a background of the display screen.

Figure 6:
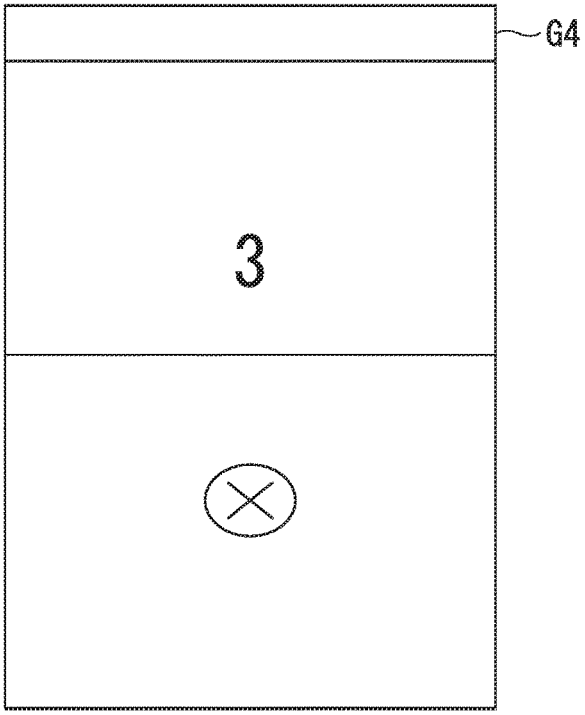
FIG. 6 is a second diagram showing an example of the recording processing screen of the musical performance support device according to the embodiment.

When the button BT7 is clicked, the recording processing unit 37 causes the display processing unit 34 to display, for example, a recording processing screen (a display screen G4) as shown in FIG. 6 on the display unit 12. Here, the display screen G4 shown in FIG. 6 is a screen on which a count value (for example, "3") of a self-timer function is displayed, and a count-down is performed according to a time setting of the self-timer.

Figure 7:
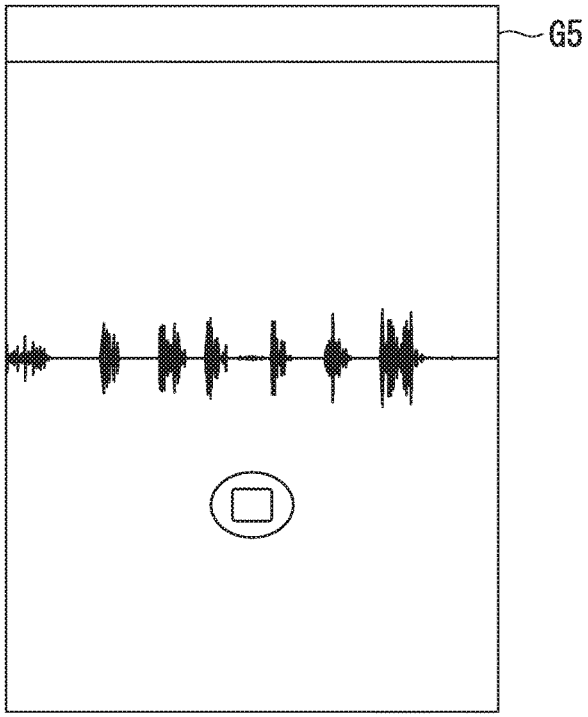
FIG. 7 is a third diagram showing an example of the recording processing screen of the musical performance support device according to the embodiment.

Further, when the count value of the self-timer reaches "0 (zero)", the recording processing unit 37 causes the display processing unit 34 to display, for example, a recording processing screen (a display screen G5) as shown in FIG. 7 on the display unit 12 and causes the storage unit 20 to store the musical performance sound data acquired from the electronic musical instrument 2 via the audio communication unit. It should be noted that an example shown in FIG. 7 is a display example when the imaging unit 13 is not used, and the display processing unit 34 displays a waveform of the musical performance sound data on the display unit 12. Further, when the imaging unit 13 is used, the display processing unit 34 displays the captured image captured by the imaging unit 13 on the background of the display screen, and the recording processing unit 37 acquires the captured image captured by the imaging unit 13 and stores (records) the captured image in the storage unit 20.

After such a recording process (the process of step S110), the recording processing unit 37 causes the process to return to step S101.

Figure 8:
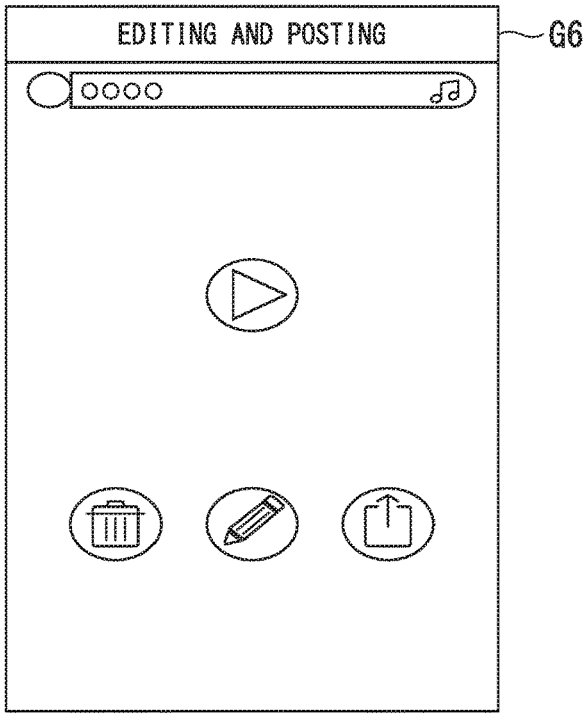
FIG. 8 is a first diagram showing an example of an editing and posting processing screen of the musical performance support device according to the embodiment.
Figure 9:
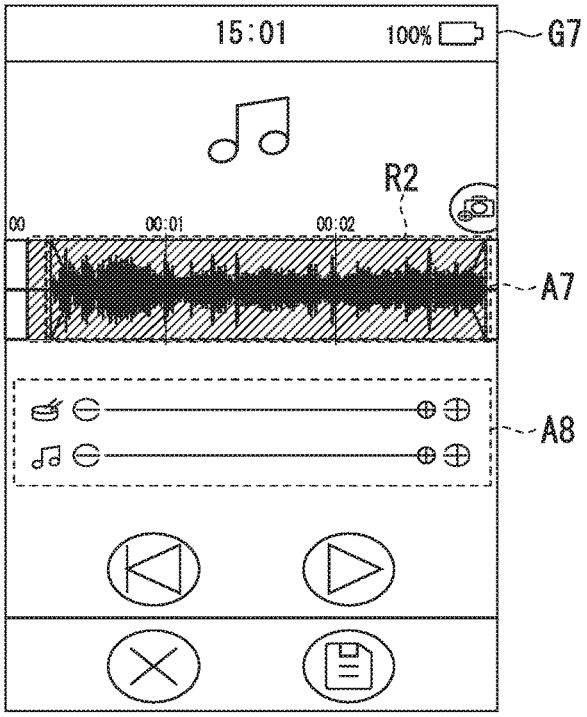
FIG. 9 is a diagram showing an example of an editing processing screen of the musical performance support device according to the embodiment.

Further, in step S111, the control unit 30 executes an editing and posting process. The editing processing unit 38 of the control unit 30 causes the display processing unit 34 to display, for example, an editing and posting processing screen (a display screen G6) as shown in FIG. 8 on the display unit 12. In the editing and posting process (the display screen G6), when the editing process is selected by the operation of the input unit 11, the editing processing unit 38 causes the display processing unit 34 to display, for example, a display screen G7 as shown in FIG. 9 on the display unit 12. The editing processing screen (the display screen G7) shown in FIG. 9 will be described herein.

FIG. 9 is a diagram showing an example of the editing processing screen of the musical performance support device 1 according to the embodiment. In FIG. 6, an area A7 is an area in which waveform data of the musical piece sound and the musical performance sound are displayed, and it is possible to set an editing range R2 by tapping and sliding the area. Further, an area A8 is an area in which the volume of the musical piece sound and the volume of the musical performance sound are adjusted, and it is possible to change the volume balance between the musical performance sound data and the musical piece sound data.

In step S111, the editing processing unit 38 mixes the musical performance sound data and the musical piece sound data according to the operation of the editing processing screen (the display screen G7) via the input unit 11 to generate content data. The editing processing unit 38 stores the generated content data in the storage unit 20. It should be noted that when the captured image captured by the imaging unit 13 is being recorded in the recording process, the editing processing unit 38 generates content data including the image.

Further, when the posting process is designated according to the operation of the input unit 11, the posting processing unit 39 executes a process of posting the content data to the server device 3 that provides a moving image sharing service and the like. The posting processing unit 39 receives the moving image sharing service of a posting destination using the input unit 11, and transmits, for example, the content data generated by the editing processing unit 38 to the server device 3 corresponding to the moving image sharing service so that the content data is stored (registered).

Figure 10:
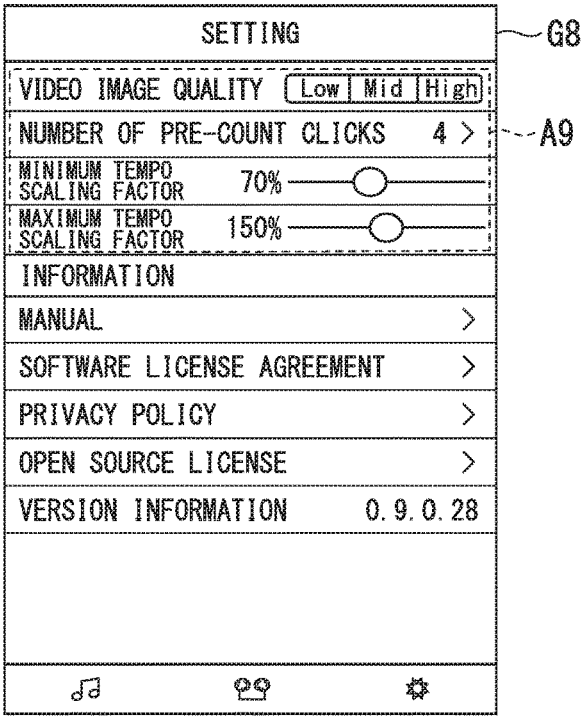
FIG. 10 is a diagram showing an example of a change of settings processing screen according to the embodiment.

Further, when the change of settings process is designated by the operation of the area A4 in step S107 described above, the setting change processing unit 36 displays, for example, a change of settings processing screen (a display screen G8) as shown in FIG. 10 on the display unit 12. The change of settings processing screen (the display screen G8) shown in FIG. 10 will be described herein.

FIG. 10 is a diagram showing an example of the change of settings processing screen according to the embodiment. In FIG. 10, an area A9 is an area in various pieces of settings information is changed. The setting change processing unit 36, for example, receives settings information of "video image quality" indicating image quality of the imaging unit 13, "number of pre-count clicks", "minimum tempo scaling factor", and "maximum tempo scaling factor" in the area A9, and changes the settings information stored in the storage unit 20.

Next, a flow of a sequence from practicing (training) for a musical performance of a user using the musical performance support device 1 according to the embodiment to recording of musical performance (recording of musical performance sound and musical performance image), creation and editing of content data of the musical performance, and posting of the content data will be described.

(1) Using the musical performance support device 1, the user hears sound obtained by adding the click sound to the musical piece sound and practices musical performance using the electronic musical instrument 2. It should be noted that at the time of practice, the user practices by bringing the tempo gradually closer to the original tempo from a slow tempo or practices by repeatedly performing the musical performance at a place of which it is difficult to repeat the musical performance, using the musical performance support device 1.

(2) Then, the user records, on a trial basis, the musical performance sound and the musical performance image of the electronic musical instrument 2 using the recording process of the musical performance support device 1 (rehearsal). The user checks the content recorded on a trial basis and executes review of various types of equipment and settings.

(3) Then, the user records audio and video of the performance for the musical performance sound and the musical performance image of the electronic musical instrument 2 using the recording process of the musical performance support device 1. It should be noted that in the musical performance support device 1 according to the embodiment, since various pieces of settings information used in the practicing (1) described above can be taken over and used as it is at the time of the recording process, it is possible to execute recording of the audio and the video of the performance in the same environment as in the practice.

(4) Then, the user edits the audio and video recording data of performance using the editing process of the musical performance support device 1. Using the editing process of the musical performance support device 1, the user, for example, deletes an unnecessary portion, adjusts volume balance of the musical performance sound data and the musical piece sound data, or generates content data for posting or for storage of memorials.

(5) Then, the user posts the generated content data to the server device 3 over the network NW1 using the posting process of the musical performance support device 1.

Thus, using the musical performance support device 1 according to the embodiment, the user can simply execute a series of processes from the practicing (training) for a musical performance of the musical piece to the recording of the musical performance (recording of the musical performance sound and the musical performance image), the creation and editing of content data of the musical performance, and the posting of the content data.

As described above, the musical performance support device 1 according to the embodiment includes the tempo analysis unit 32, the click generation unit 33, and the sound output processing unit 35 (sound emission processing unit). The tempo analysis unit 32 analyzes the tempo of the musical piece sound data indicating the musical piece sound. The click generation unit 33 generates a click sound to beat out a predetermined rhythm on the basis of the tempo analyzed by the tempo analysis unit 32. The sound output processing unit 35 adds the click sound generated by the click generation unit 33 to the musical piece sound according to the musical piece sound data and causes a resultant sound to be emitted from the loudspeaker 14 (a sound emission unit).

Accordingly, in the musical performance support device 1 according to the embodiment, since it is easy to play a musical piece sound on the electronic musical instrument 2 with the click sound, it is possible to improve convenience in practicing musical performance.

Further, the musical performance support device 1 according to the embodiment includes the setting change processing unit (a change processing unit) 36 and the display processing unit 34. The setting change processing unit 36 changes the tempo of the musical piece sound to be emitted by the sound output processing unit 35 according to the tempo change request, and changes a generation time interval of the click sound generated by the click generation unit 33, according to the change in the tempo of the musical piece sound. The display processing unit 34 displays tempo information (for example, a BPM value) indicating the tempo of the musical piece sound to be emitted by the sound output processing unit 35 on the display unit 12.

Accordingly, since the musical performance support device 1 according to the embodiment allows practicing for a musical performance using the electronic musical instrument 2 by changing the tempo of the musical piece sound, it is possible to further improve the convenience in practicing for the musical performance. That is, the musical performance support device 1 according to the embodiment allows practicing for a musical performance by changing the tempo of the musical performance according to a level of improvement of the musical performance. Further, since the musical performance support device 1 according to the embodiment displays the tempo information (for example, a BPM value) on the display unit 12, the user can accurately recognize the improvement level of the musical performance.

Further, in the embodiment, the setting change processing unit 36 changes the beat settings information for selecting any one of an on beat and an off beat according to a click sound change request. The click generation unit 33 generates a click sound corresponding to any one of the on beat and the off beat on the basis of the beat settings information.

Accordingly, since the musical performance support device 1 according to the embodiment can generate the click sound by selecting any one of the on beat and the off beat, it is possible to efficiently practice for the musical performance using the electronic musical instrument 2 and to improve a musical performance technique.

Further, in the embodiment, the tempo analysis unit 32 analyzes the tempo of the musical piece sound data in the analysis range designated by the input unit, in the musical piece sound data.

Accordingly, since the musical performance support device 1 according to the embodiment, for example, appropriately analyzes the tempo by excluding portions unnecessary for analysis, it is possible to improve the accuracy of the tempo analysis.

Further, the musical performance support device 1 according to the embodiment includes the recording processing unit 37 (an audio recording processing unit) and the editing processing unit 38 (a content generation unit). The recording processing unit 37 acquires the musical performance sound data indicating the musical performance sound played by the musical instrument according to the musical piece sound emitted by the loudspeaker 14 and stores the acquired performance sound data in the storage unit 20. The editing processing unit 38 generates content data on the basis of the musical performance sound data stored in the storage unit 20 by the recording processing unit 37 and the musical piece sound data.

Accordingly, since the musical performance support device 1 according to the embodiment can collectively perform processes from practicing for a musical performance to the acquisition of the musical performance sound data and the generation of the content data, it is possible to further improve the convenience. It should be noted that the user can easily transmit information on his or her own musical performance using the musical performance support device 1 according to the embodiment. Further, since the musical performance support device 1 according to the embodiment can take over and use an environment used in the practice as it is at the time of acquisition of the musical performance sound data, it is possible to generate content data of the musical performance in the same environment as in the practice. Further, the musical performance support device 1 according to the embodiment can be used by being connected to the electronic musical instrument 2 and, for example, does not have to separately include an audio interface device or the like.

Further, the musical performance support device 1 according to the embodiment includes the posting processing unit 39 that transmits the content data generated by the editing processing unit 38 to the server device 3 that can be connected over the network NW1 and causes the content data to be stored.

Accordingly, since the musical performance support device 1 according to the embodiment can collectively perform processes up to the posting of the content data, it is possible to further improve the convenience. Further, since the musical performance support device 1 according to the embodiment can increase opportunities for information transmission regarding the musical performance of the user, it is possible to enhance motivation regarding the musical performance of the electronic musical instrument 2.

Further, the musical performance support device 1 according to the embodiment includes the sound output processing unit 35 (a sound emission processing unit), the recording processing unit 37 (an audio recording processing unit), and the editing processing unit 38 (a content generation unit). The sound output processing unit 35 causes the musical piece sound according to the musical piece sound data to be emitted from the loudspeaker 14 (a sound emission unit) according to the set settings information. According to the settings information, the recording processing unit 37 (an audio recording processing unit) acquires the musical performance sound data indicating the musical performance sound played by the musical instrument according to the musical piece sound emitted from the loudspeaker 14 (a sound emission unit) and stores the acquired performance sound data in the storage unit 20. The editing processing unit 38 generates content data on the basis of the musical performance sound data stored in the storage unit 20 by the recording processing unit 37 and the musical piece sound data.

Accordingly, in the musical performance support device 1 according to the embodiment, since the settings information used in practice can be taken over and used as it is at the time of acquisition of the musical performance sound data, it is possible to generate the content data of the musical performance in the same environment as in the practice and to improve convenience.

Further, the musical performance support device 1 according to the embodiment separately stores the musical piece sound data and the musical performance sound data in the storage unit 20, and the editing processing unit 38 generates content data on the basis of the individual musical piece sound data and the musical performance sound data. Therefore, in the musical performance support device 1 according to the embodiment, it is possible to increase a degree of freedom in the editing process, as compared with a case in which sound data in which the musical piece sound data and the musical performance sound data are mixed is stored.

Further, it should be noted that the present invention is not limited to the above-described embodiment and can be modified without departing from the gist of the present invention.

For example, in the above embodiment, the example in which the musical piece sound and the performance sound are emitted (output) from the loudspeaker 14 included in the musical performance support device 1 has been described as an example of the sound emission unit, but the present invention is not limited thereto. For example, the sound emission unit may be a headphone connected to the musical performance support device 1 or the electronic musical instrument 2 or may be a loudspeaker device connected to the electronic musical instrument 2.

Further, in the above embodiment, the example in which the audio communication unit 15 is the interface unit conforming to the USB Audio Class standard has been described, but the present invention is not limited thereto, and the audio communication unit 15 may be, for example, a wireless communication interface unit such as one using Bluetooth. Further, the musical performance support device 1 and the electronic musical instrument 2 may communicate with each other through another interface.

Further, in the above embodiment, the example in which the musical performance support device 1 includes the imaging unit 13 has been described, but the present invention is not limited thereto and the imaging unit 13 may be externally included.

Further, in the above embodiment, the example in which the electronic musical instrument 2 is an electronic drum has been described, but the present invention is not limited thereto and other electronic musical instruments may be used.

In the above embodiment, the example in which the musical performance support device 1 is, for example, a smartphone or a PC has been described, but the musical performance support device 1 may be an information terminal such as a personal digital assistant (PDA).

Further, in the above embodiment, the example in which the posting processing unit 39 posts (uploads) the content data to the server device 3 for a moving image sharing service or the like has been described, but the server device 3 that is a posting destination may be a server device for a social networking service (SNS) or a cloud server available to a user.

Further, in the above-described embodiment, the musical performance support device 1 may restrict (prohibit) execution of some of the respective functions from the practicing (training) for a musical performance of the musical piece to the recording of the musical performance (the recording of the musical performance sound and the musical performance image), the creation and editing of content data of the musical performance, and the posting of the content data, according to the connected electronic musical instrument 2. For example, the musical performance support device 1 may acquire, for example, identification information from the electronic musical instrument 2, and enable the electronic musical instrument 2 (for example, an electronic musical instrument available from a specific manufacturer) corresponding to specific identification information to execute recording and subsequent functions when the electronic musical instrument 2 is connected to the musical performance support device 1.

It should be noted that each configuration included in the musical performance support device 1 described above includes a computer system therein. The process in each configuration included in the musical performance support device 1 described above may be performed by recording a program for realizing the function of each configuration included in the musical performance support device 1 described above on a computer-readable recording medium, loading the program recorded on the recording medium into a computer system, and executing the program. Here, "causing a program recorded onto a recording medium to be loaded to the computer system and executing the program" includes installing the program on the computer system. Here, the "computer system" includes an OS and hardware such as peripheral devices.

Further, the "computer system" may include a plurality of computer devices connected via a network including a communication line such as the Internet, a WAN, a LAN, or a dedicated line. Further, the "computer-readable recording medium" refers to a portable medium such as a flexible disk, a magneto-optical disc, a ROM, or a CD-ROM, or a storage device such as a hard disk built into the computer system. Thus, the recording medium storing the program may be a non-transitory recording medium such as a CD-ROM.

Further, the recording medium also includes a recording medium provided internally or externally and accessible from a distribution server in order to distribute the program. It should be noted that there may be a configuration in which the program is divided into a plurality of programs, and respective programs are downloaded at different times and then combined in each component included in the musical performance support device 1, and the distribution server that distributes each of the separate programs may be different. Further, the "computer-readable recording medium" also includes a recording medium that holds a program for a short period of time, such as a volatile memory (RAM) inside a computer system serving as a server or a client when the program is transmitted over a network. Further, the program may be a program for realizing some of the above-described functions. Further, the program may be a program capable of realizing the above-described functions in combination with a program previously stored in the computer system, that is, a so-called differential file (differential program).

Further, some or all of the above-described functions may be realized as an integrated circuit such as a large scale integration (LSI). Each functional block described above may be individually realized as a processor, or a portion or all thereof may be integrated and realized as a processor. Further, an integrated circuit realization scheme is not limited to an LSI and may be realized as a dedicated circuit or a general-purpose processor. Further, in a case in which an integrated circuit realization technology with which an LSI is replaced appears with the advance of a semiconductor technology, an integrated circuit according to this technology may be used.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A musical performance support device comprising:

a processor configured to implement instructions stored in a memory and execute a plurality of tasks, including:

a tempo analysis task that analyzes a tempo of musical piece sound data, the musical piece sound data indicating a musical piece sound;

a sound generation task that generates a sound based on the analyzed tempo, the generated sound indicating a beat of the musical piece sound data; and a sound processing task that adds the generated sound to the musical piece sound, wherein the tempo analysis task analyzes the tempo of the musical piece sound data in an analysis range designated by an input device.

2. The musical performance support device according to claim 1, wherein the plurality of tasks include:

a change processing task that changes a time interval of the generated sound according to a change in the tempo of the musical piece sound; and a display processing task that controls a display device to display tempo information indicating the tempo of the musical piece sound.

3. The musical performance support device according to claim 2, wherein:

the change processing task changes beat settings information according to a change request, the beat settings information indicating which one of an on beat or an off beat is selected, and the sound generation task generates, as the generated sound, a sound corresponding to one of the on beat or the off beat according to the beat settings information.

4. The musical performance support device according to claim 1, wherein the plurality of tasks include:

an audio recording processing task that acquires musical performance sound data indicating a musical performance sound played according to the musical piece sound and stores the acquired musical performance sound data in a storage device; and a content generation task that generates content data based on the stored musical performance sound data and the musical piece sound data.

5. The musical performance support device according to claim 4, wherein the content generation task changes a volume balance between the musical performance sound data and the musical piece sound data and mixes the musical performance sound data with the musical piece sound data.

6. The musical performance support device according to claim 4, wherein the content generation task changes a range of the musical performance sound data and the musical piece sound data and generates the content data in the changed range.

7. The musical performance support device according to claim 4, wherein the plurality of tasks include:

a posting processing task that transmits the generated content data to a server device, the server device being connectable to the musical performance support device via a network, the posting processing task causing the generated content data to be stored in the server device.

8. The musical performance support device according to claim 1, wherein the plurality of tasks include:

a change processing task that changes a time interval of the generated sound according to a change in the tempo of the musical piece sound.

9. The musical performance support device according to claim 1, wherein the plurality of tasks include:

a display processing task that causes a display device to display tempo information indicating the tempo of the musical piece sound.

10. The musical performance support device according to claim 1, wherein the plurality of tasks include:

a change processing task that changes selection of one of an on beat or an off beat.

11. A musical performance support device comprising:

a processor configured to implement instructions stored in a memory and execute a plurality of tasks, including:

a tempo analysis task that analyzes a tempo of musical piece sound data, the musical piece sound data indicating a musical piece sound;

a sound generation task that generates a sound based on the analyzed tempo, the generated sound indicating a beat of the musical piece sound data; and a sound processing task that adds the generated sound to the musical piece sound, wherein the sound generation unit generates, as the generated sound, a sound corresponding to an on beat or an off beat.

12. The musical performance support device according to claim 1, wherein the sound processing task supplies a loudspeaker with the musical piece sound to which the generated sound is added.

13. The musical performance support device according to claim 1, wherein the generated sound comprises a click sound.

14. A non-transitory computer-readable recording medium storing a program executable by a computer to execute a method comprising the steps of:

analyzing a tempo of musical piece sound data, the musical piece sound data indicating a musical piece sound;

generating a sound based on the analyzed tempo, the generated sound indicating a beat of the musical piece sound data; and adding the generated sound to the musical piece sound, wherein the tempo analyzing step analyzes the tempo of the musical piece sound data in an analysis range designated by an input device.

15. A musical performance support method comprising the steps of:

analyzing a tempo of musical piece sound data, the musical piece sound data indicating a musical piece sound;

generating a sound based on the analyzed tempo, the generated sound indicating a beat of the musical piece sound data; and adding the generated sound to the musical piece sound, wherein the tempo analyzing step analyzes the tempo of the musical piece sound data in an analysis range designated by an input device.

* * * * *